United States Patent [19]

Dougherty et al.

[11] 4,356,606

[45] Nov. 2, 1982

[54] SHADOW MASK INSERTER APPARATUS AND METHOD

[75] Inventors: Lawrence W. Dougherty, Sleepy Hollow; William H. Meyle, Naperville, both of Ill.

[73] Assignee: Zenith Radio Corporation, Glenview, Ill.

[21] Appl. No.: 191,887

[22] Filed: Sep. 29, 1980

[51] Int. Cl.[3] ..... H01J 9/02

[52] U.S. Cl. ..... 29/25.15; 29/25.19

[58] Field of Search ..... 29/25.13, 25.15, 25.19

[56] References Cited

U.S. PATENT DOCUMENTS

| | | | |
|---|---|---|---|
| 3,899,812 | 8/1975 | Baranski et al. | 29/25.19 |
| 4,130,919 | 12/1978 | Oyama | 29/25.19 |
| 4,138,774 | 2/1979 | Oyama | 29/25.19 |
| 4,164,060 | 8/1979 | Hartta | 29/25.19 |
| 4,188,695 | 2/1980 | Oyama | 29/25.19 |

FOREIGN PATENT DOCUMENTS

| | | | |
|---|---|---|---|
| 54-147774 | 11/1979 | Japan | 29/25.19 |
| 55-72337 | 5/1980 | Japan | 29/25.19 |

*Primary Examiner*—John McQuade
*Attorney, Agent, or Firm*—Ralph E. Clarke, Jr.

[57] ABSTRACT

Apparatus is disclosed for use in the manufacture of a color cathode ray picture tube. The tube has a glass face panel with a rearwardly extending flange with a plurality of studs extending radially inwardly from the flange. The tube includes a shadow mask suspended in precise proximity to the panel by an equal plurality of leaf springs. The rearwardly extending springs are attached to the mask in an orientation substantially parallel with the axis of said tube. The springs have an aperture at the distal end for engagement with an associated one of the studs. Engagement means for each of the springs for engaging the apertures with the studs during insertion of the mask into the panel comprise the following: Spring depressor means provide for bending the spring adjacent to the mask, and the spring depressor means include channel means parallel with the spring for accepting the distal end of the spring. V-groove tip means at a distal end of the spring depressor means and aligned with the channel means provide for locating and aligning the stud with the channel means. Pusher means provide for pushing the distal end of the spring along the channel toward and over the stud during mask insertion. As a result, as the distal ends of the springs are pushed over the studs, the apertures, being aligned with the studs, positively snap into substantial engagement with the studs, after which the V-groove tip means are withdrawn, thus providing consistent and unequivocal mutual engagement of the mask with the panel.

5 Claims, 11 Drawing Figures

SHADOW MASK INSERTER APPARATUS AND METHOD

CROSS-REFERENCE TO RELATED APPLICATIONS

This application is related to but in no way dependent upon application Ser. No. 101,959 filed Dec. 10, 1979, now U.S. Pat. No. 4,300,071 of common ownership herewith.

BACKGROUND OF THE INVENTION AND PRIOR ART DISCLOSURES

The present invention relates generally to production machinery used in the manufacture of color cathode ray picture tubes, and is particularly directed to apparatus and method for inserting a shadow mask into the face panel.

The shadow mask is of the type disclosed in U.S. Pat. No. 4,100,451 to Palac, of common ownership herewith. The face panel into which the shadow mask is to be inserted is substantially rectangular and supports on a concave inner surface thereof in a central region a phosphor screen comprising patterns of red-, blue-, and green- emissive phosphor compounds deposited in stripe form and grouped into triads comprising the three colors. The low-mass, approximately rectangular shadow mask has a central portion with a pattern of electron-transmissive apertures in registry with associated ones of the triads. The mask has a skirt portion providing substantial rigidity with respect to axes normal to the side thereof, while providing for flexure of the mask with respect to its diagonals. The suspension system for the mask establishes a predetermined position of the mask relative to, and at a predetermined spacing from, the inner surface of the face panel. The system includes four suspension means for mechanically coupling the mask directly to the corner portions of the face panel. The suspension means are located at each corner of the mask to permit the mask to flex about its diagonals and conform to the contour of the face panel despite any twist-wise deformation thereof. By this means, the predetermined spacing between the mask and the face panel inner surface is maintained.

FIG. 1 depicts in detail the aforedescribed mask-face panel assembly 10 which comprises a substantially rectangular, frameless, shadow mask 12 having a dished perforate central section 14 and a rearwardly extending skirt 16. Mask 12 has an integral rim 18 extending radially outwardly from the rear edge of the mask skirt 16; integral rim 18 serves as an electron beam shield and provides added stiffness to mask 12. Mask 12 is relatively stiff about its major axis 20 and minor axis 22, but torsionally flexible and unstable with respect to diagonals 24 and 26. Shadow mask 12 is shown as cut away in FIG. 1 to reveal a glass face panel 28 having a dished central section 30. Face panel 28 has a rearwardly extending flange 32. Enlarged area 31 depicts the pattern of apertures in mask 12, ones of which are in registry with associated ones of the phosphor stripes deposited on face panel 28, indicated by enlarged area 33.

A corner mask suspension system for rigidly and stably suspending mask 12 from the dished central section 30 of face panel 28 is shown as comprising four suspension devices 34. One such device is located at each corner of the mask 12 to provide four-corner mounting. In consequence of the four-corner mounting system, the mask, which is low in cost but inherently lacking in self-rigidity due to its one-piece, frameless construction, is suspended with high rigidity derived from flange 32 of face panel 28, and high stability derived from the four-corner, diagonal mounting.

With additional reference to FIG. 2, there is shown in detail a corner mask suspension device 34 and associated components. A lip 36 may extend downwardly from rim 18 of mask 12 to add stiffness to mask 12. A stud 38 is shown as being affixed to the face panel flange 32 on the associated face panel diagonal 26. Stud 38 is arranged to extend radially inwardly along diagonal 26, as indicated.

An outwardly biased leaf spring 40 provides for detachably interconnecting the corner of mask 12 to stud 38 on the rearwardly extending flange 32 of face panel 28. Spring 40 has an aperture 41 at its distal end 42 for detachably interconnecting the mask corner to the face panel flange 32 by engagement of aperture 41 with stud 38. Spring 40 is depicted as being attached to bracket 43, which in turn is shown as being attached to skirt 16 of mask 12. It will be observed that when spring 40 is deflected, its distal end 42 will travel on an arc inwardly toward the face panel central axis, as indicated by arrow 44. Rearwardly extending leaf spring 40 will be seen to have its distal end 42 readily accessible for facile insertion and removal of mask 12 from face panel 28.

This corner mask-suspension system if fully described and claimed in referent copending application Ser. No. 101,959. Leaf spring 40 is depicted in FIG. 2 as having a radially extending lip 45 at its distal end 42.

The well-known process of successive application of the color phosphors and other screening fluids to the inner surface of the face panel requires that the shadow mask be removed and inserted in proper registration several times during production. Upon each re-insertion, the shadow mask must re-assume its precise proximate position with respect to the associated face panel; the required tolerance in directions perpendicular to the axis of the cathode ray tube is $\pm 0.0004$ inch. Any mispositioning of the shadow mask beyond this limit from its predetermined precise location will result in misregistry of the electron beams that excite the phosphors. The result of such misregistry can be color impurities, white non-uniformities, and other deleterious effects that degrade color television picture quality.

Although the shadow mask can be inserted into and removed from the face panel manually, it is far more efficient to perform the operation by an automatic apparatus. By its nature, such an apparatus is quicker, more positive in operation, and is less likely to damage the face panel and/or the mask in the mask insertion and removal operation. Also, foreign matter such as airborne dust and human hair is less likely to fall onto the mask or phosphor screen as the panel is handled open-side-down by the apparatus. The presence of such foreign matter in active areas of the face panel assembly can result in rejection of the cathode ray tube of which the assembly is a part.

The major constraint in the design of shadow mask inserters lies in the unpredictable variance in dimensions of face panels which may exhibit deviations of as much as $\pm 0.075$ inch. Additional deviations of as much as 0.050 inch may exist in the shadow mask. These deviations relate to variations in the length of springs, spring curvature, aperture dimensions and point of attachment with respect to the shadow mask. It is to be noted that the dimensional deviations set forth—0.075 inch for the face panel and 0.050 inch for the mask—can be additive, and the totality must be taken into consideration in the design of automatic apparatus. If the tolerances are not taken into consideration, a condition may occur wherein one or more of the spring apertures may entirely escape engagement with the associated studs.

Representative apparatus for automatic insertion of shadow masks is disclosed by the following U.S. Pat. Nos:

Baranski et al—3,889,812
Oyama—4,188,695
Hartta—4,164,060.

These disclosures are directed to the insertion of shadow masks wherein the suspension springs are parallel with a mask frame on which they are mounted.

OBJECTS OF THE INVENTION

It is a general object of this invention to provide apparatus and method for the assembly of a color television tube shadow mask and face panel.

It is a more specific object of the invention to provide mask-inserter apparatus and method for the assembly of shadow masks suspended at the four corners of a substantially rectangular face panel.

It is a specific object of the invention to provide apparatus and method for the insertion of a frameless shadow mask into a face panel wherein the mask is suspended by four corner-mounted, rearwardly extending springs.

BRIEF DESCRIPTION OF THE DRAWINGS

The features of the present invention which are believed to be novel are set forth with particularity in the appended claims. The invention, together with objects and advantages thereof, may best be understood, however, by reference to the following description taken in conjunction with the accompanying drawings, in the several figures of which like reference numerals identify like elements and in which:

DESCRIPTION OF THE PREFERRED EMBODIMENTS

Figure 1:
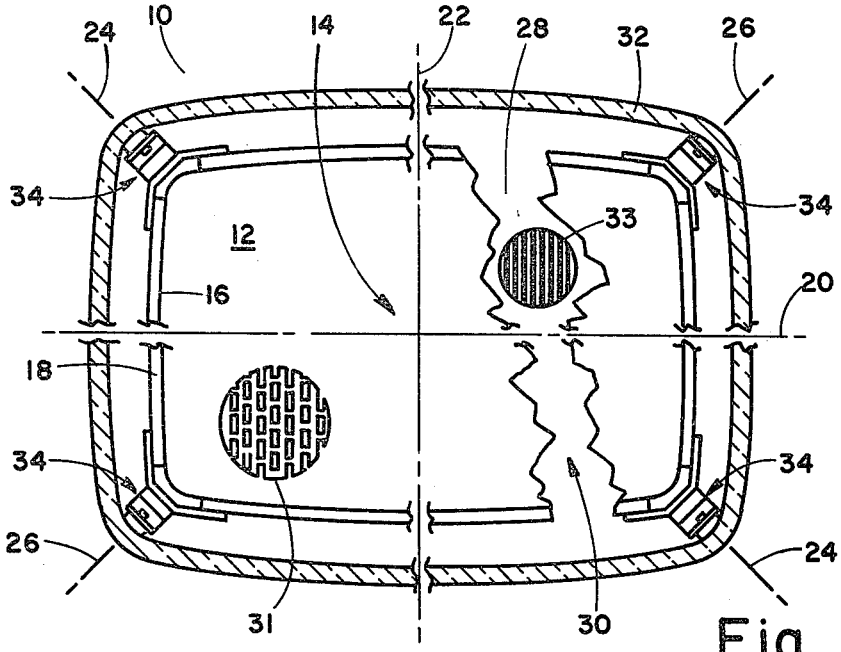
Fig. 1 PRIOR ART
FIG. 1 is a plan view of the faceplate-shadow mask assembly with a partially cut away shadow mask, showing details of the assembly and a novel four-corner mask suspension system.
Figure 2:
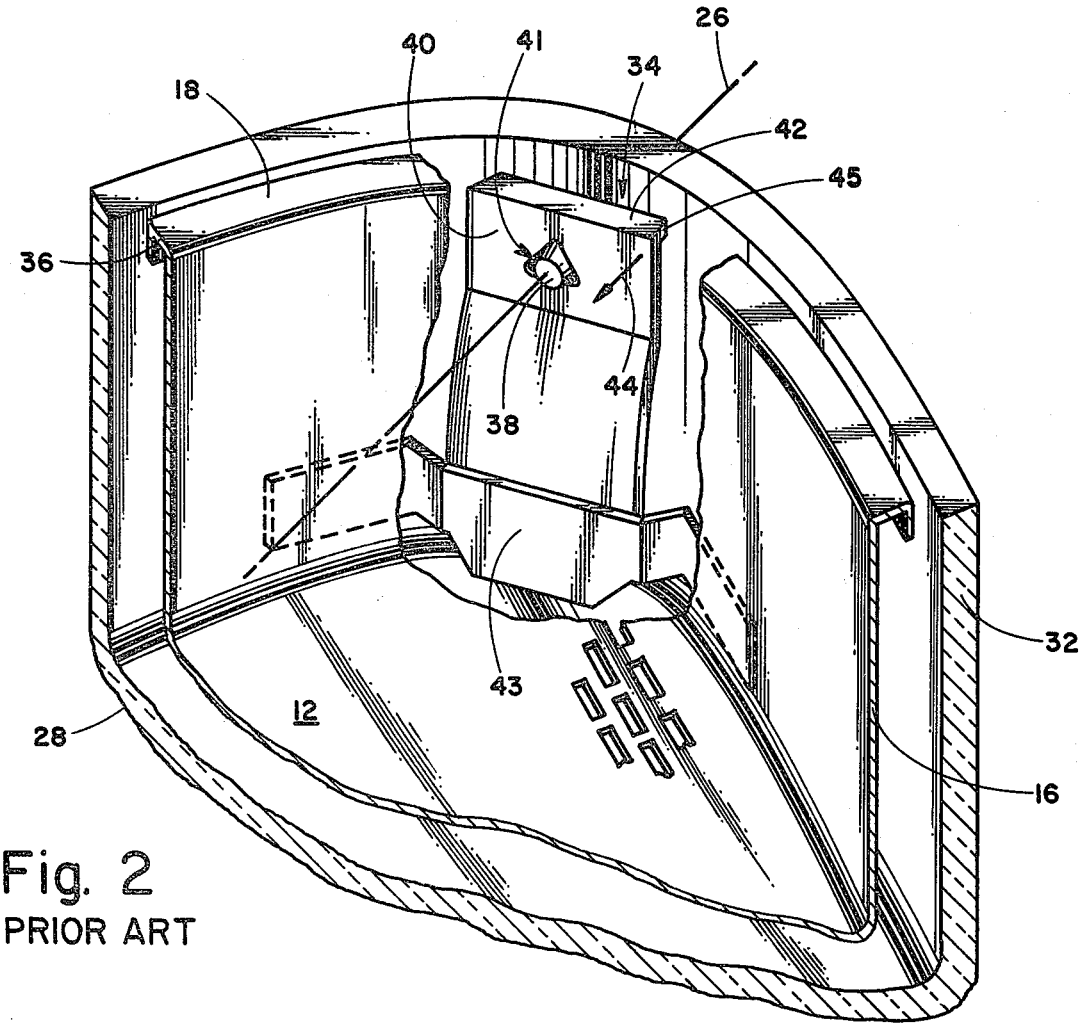
Fig. 2 PRIOR ART
FIG. 2 is an oblique view in perspective of a corner of a faceplate with the shadow mask partially cut away to depict details of one of the corner mask suspension means shown by FIG. 1.
Figure 3:
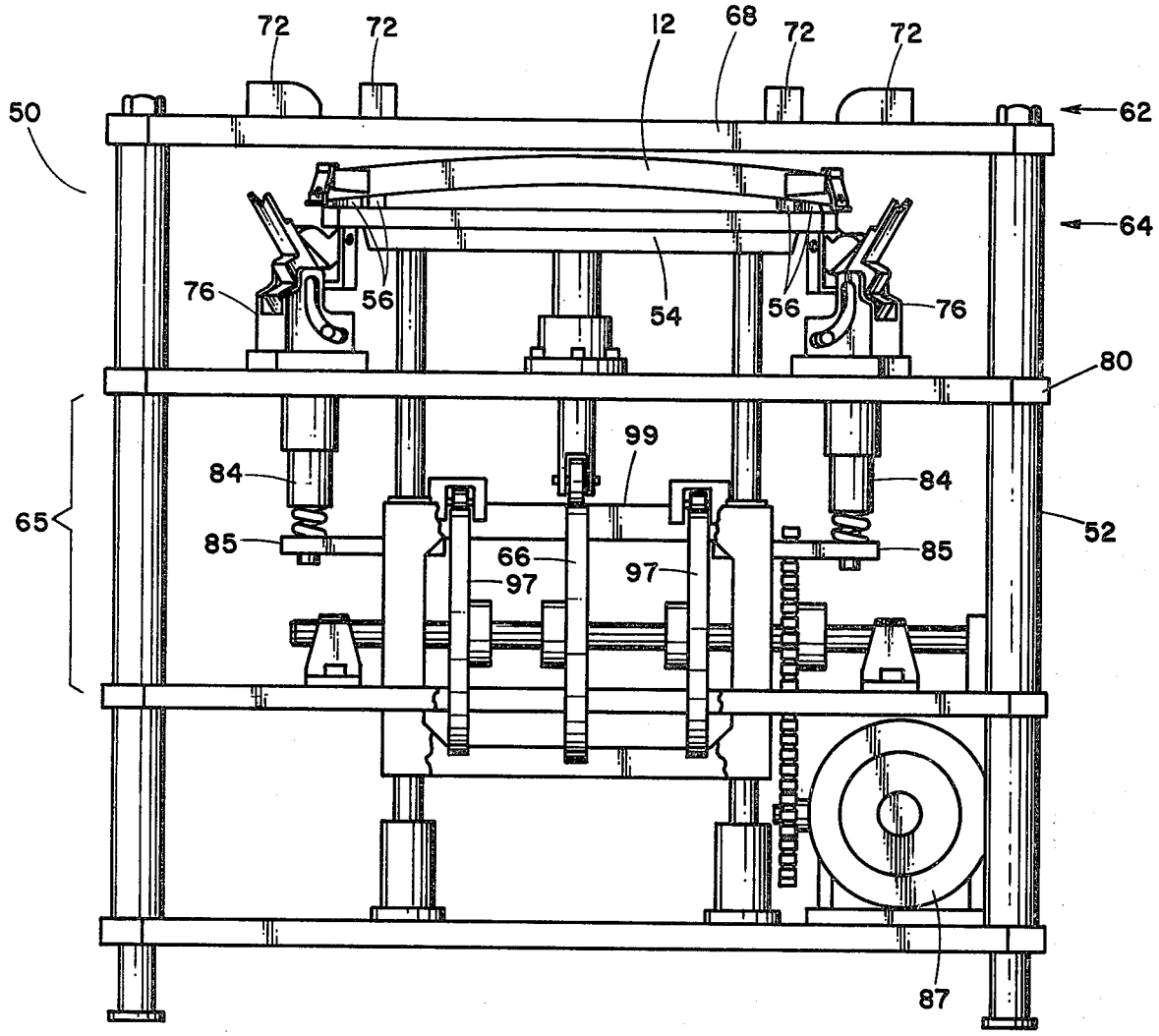
FIG. 3 is a view in elevation of a mask-inserter apparatus according to the invention partially in cross-section, and depicting the elevator means by which the shadow mask is brought into conjunction with a face panel for engagement therewith.
Figure 4:
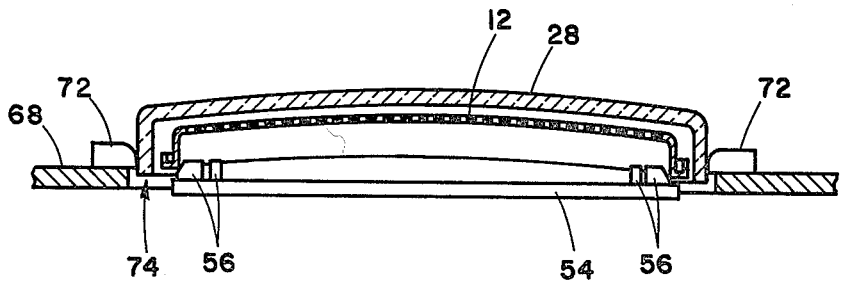
FIG. 4 depicts such a conjunction.

Apparatus for use in the manufacture of a color cathode ray picture tube for inserting a shadow mask 12 into a glass face panel 28 according to the invention is shown by FIGS. 3 and 4. The apparatus 50 is indicated as comprising a main frame 52 for support of the components of the apparatus. Platen means 54 with mask prelocating means 56 provide for receiving and prelocating shadow mask 12 convex-side-up on platen means 54, as indicated. Mask prelocating means 56 comprise blocks having tapered faces for accepting the skirt 16 of mask 12.

Elevator means provide for raising and lowering platen means 54 between an upper assembly position 62 and a lower preassembly position 64. The general location of the components of the platen elevator means, which may comprise the standard well-known-in-the-art cam-actuated vertically sliding members depicted, is indicated by bracket 65. Platen means 54 is indicated in FIG. 3 as being in the lower pre-assembly position 64, and in FIG. 4, in upper assembly position 62. Platen 54 is raised and lowered by the rotation of center cam 66.

Table means 68, located in upper assembly position 62, provides for receiving the substantially rectangular face panel 28 convex-side-up with respect to mask 12. Blocks 72 provide for approximately pre-locating panel 28 with respect to mask 12. Table 68 is depicted as having an opening 74 for receiving the platen 54 in approximate coplanarity when platen 54 is raised by the rotation of center cam 66 to its upper assembly position 62.

Figure 5:
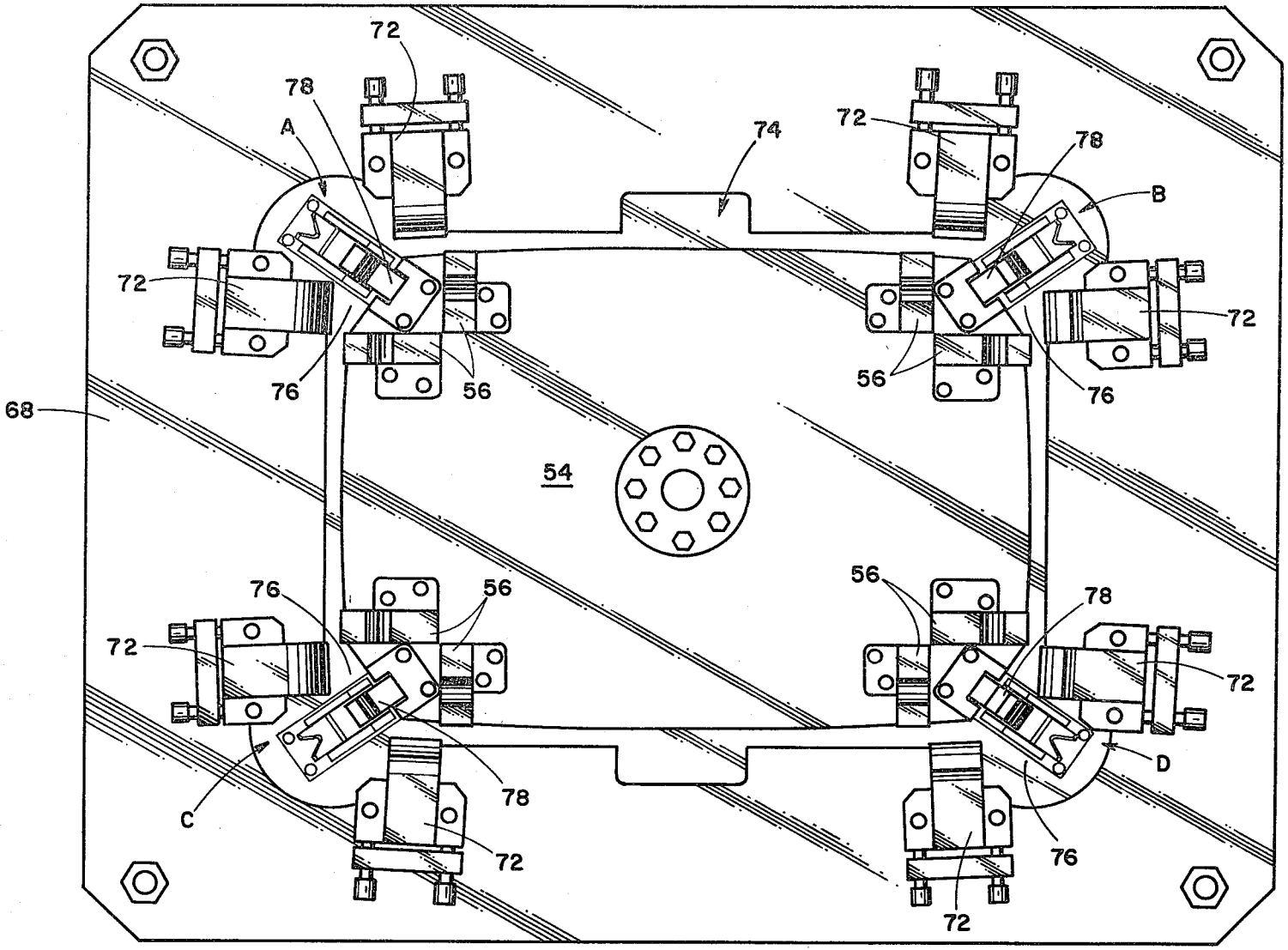
FIG. 5 is a plan view of the top of the apparatus according to the invention with the table top cut away to indicate the location and relationship of essential components for accomplishing the objectives of the invention.
Figure 6:
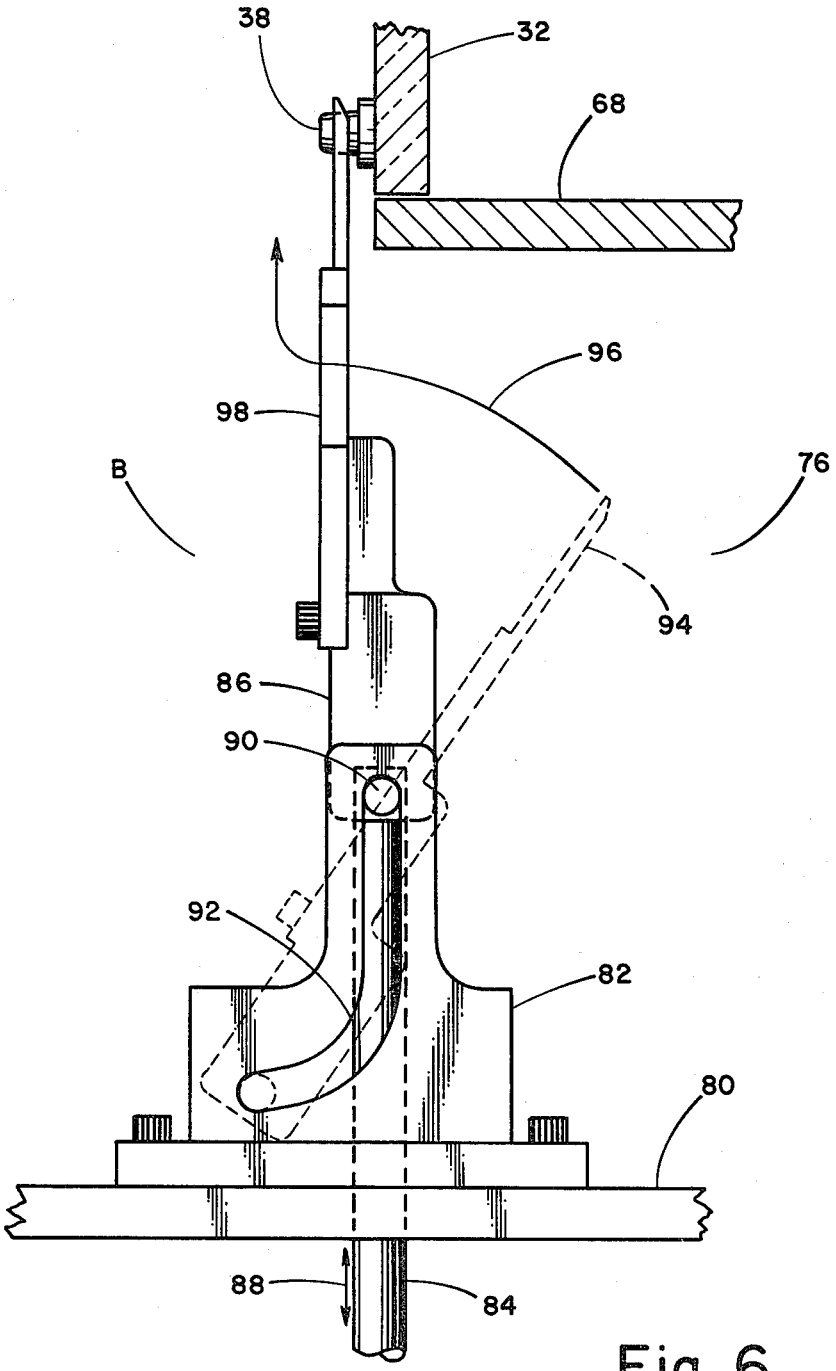
FIG. 6 is a view in elevation and partially in section of a spring engagement means according to the invention.

Means are provided at the lower, pre-assembly position 64 for preparing mask 12 for engagement with face panel 28. FIG. 5 is a plan view of table means 68 partially cut away to reveal four groups of components designated as groups A, B, C, and D, each comprising a spring engaging means 76. The groups are essentially identical in structure and operation, but with minor differences as will be described. FIG. 6 provides a detail view in elevation of the components of group B, which are representative of the components of groups A, C, and D, and FIGS. 7–10B provide a detailed views of the components as described in the following paragraphs. FIG. 5 also shows the four spring pushers 78, located one in each corner of platen 54 as indicated. Although hingedly extending from the corners of platen 54, spring pushers 78 comprise a cooperating part of the associated spring engaging means 76 in each group A-D.

FIG. 6 shows in greater detail the components which provide for engaging leaf springs 40 with associated studs 38 according to the invention. Spring engaging means 76 is shown as being mounted on a second table 80 located beneath table 68. Spring engaging means 76 includes an upright 82 through which slidably passes a push rod 84 linked to an arm 86. Vertical movement of push rod 84 in the directions indicated by arrow 88 results in a corresponding up and down movement of arm 86. The excursion of arm 86 is controlled by cam follower 90 which travels in groove cam 92. The traverse of arm 86 from the "laid back" position 94 indicated by the dash lines, to the full-height position depicted is indicated by arrow 96. The vertical movement of push rod 84 is in response to the rotation of cams 97, shown by FIG. 3. Cams 97, which rotate in unison, in turn provide for the vertical movement of vertically slide-mounted box frame 99 which provide for vertical movement of push rods 84 by means of brackets 85. Cams 66 and 97 are caused to rotate in unison by a motor 87 having a speed-reducing gear head.

Figure 7:
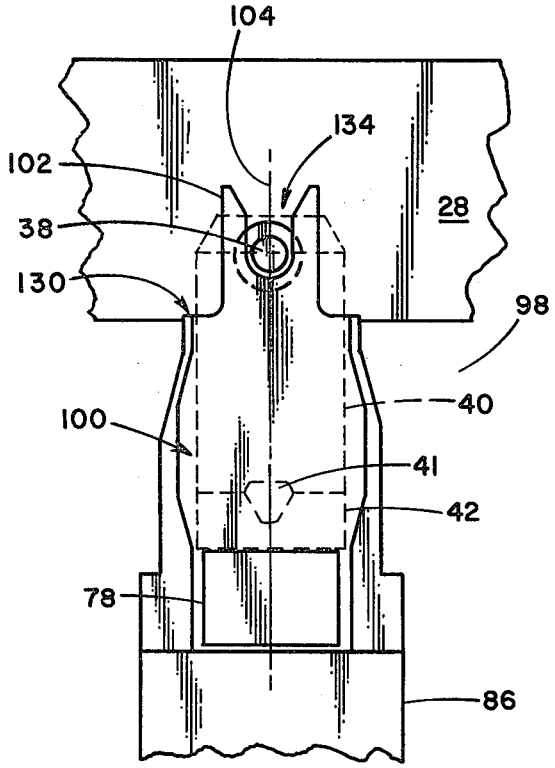
FIG. 7 is a detail plan view of a section of the means shown by FIG. 6.
Figure 10A:
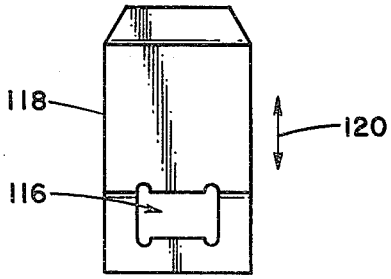

Arm 86 is surmounted by a spring depressor means 98, indicated in FIG. 6 as engaging stud 38. A detailed plan view of spring depressor means 98 as mounted on arm 86 is shown by FIG. 7. Spring depressor means 98 provides for bending the distal end of 42 of spring 40, shown in dashed outline, adjacent to the mask 12, as will be described. Spring depressor means 98 includes channel means 100, shown as being parallel to leaf spring 40 for accepting distal end 42 of spring 40. Channel means 100 is, by way of example, about one-eighth inch deep. The V-groove tip means 102 is located at the distal end of spring depressor means 98 and channel means 100 for locating and aligning stud 38 with channel means 100. The alignment of channel means 100 with stud 38 is indicated by the intersection of channel centerline 104 with the approximate center of stud 38. The V-groove tip means 102, in locating and aligning studs 38 with channel means 100, raise panel 28 from table 68 about 0.125 inch.

Figure 8:
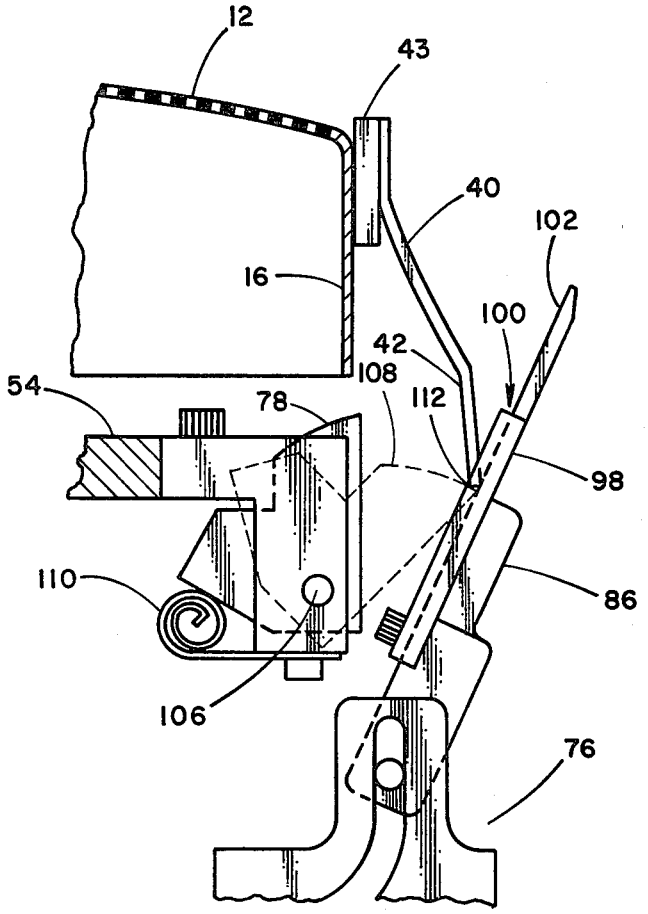
FIG. 8 is an elevational view of a spring engaging means showing the relationship of cooperating components preliminary to engagement.

Spring pusher means 78 provides for pushing spring 40 along channel 100 toward and over stud 38, as will be described. Spring pusher means 78, although attached to platen 54 is, as has been noted, a cooperating part of spring engaging means 76. FIG. 8 depicts in detail one spring pusher 78 hingedly extending from a corner of platen 54. Spring pusher means 78, hinged at hinge pin 106, is foldable into platen 54, as indicated by dash line configuration 108, and is spring-biased outwardly by coil spring 110 so that spring pusher means 78 will make contact with channel 100 of spring depressor means 98 when spring depressor means 98 is moved inwardly toward platen means 54.

As platen 54 moves upwardly toward upper assembly position 62, it rises concurrently with spring depressor means 98; both are propelled by respective cams 66 and 97. As spring depressor means 98 moves upwardly, it also moves inwardly to bend the spring 40 into close adjacency to mask skirt 16. As spring depressor means 98 moves inwardly, channel means 100 accepts the distal end 42 of spring 40. It will be noted from FIG. 7 that channel means 100 is wider than spring 40 at the approximate point where it accepts spring 40; this latitude is provided to ensure positive entrance of spring 40 into channel 100. It will also be noted that channel 100 narrows to a width slightly more than the width of the spring 40 to ensure that aperture 41 of spring 40 is properly aligned with stud 38 at the point of engagement.

Figure 9:
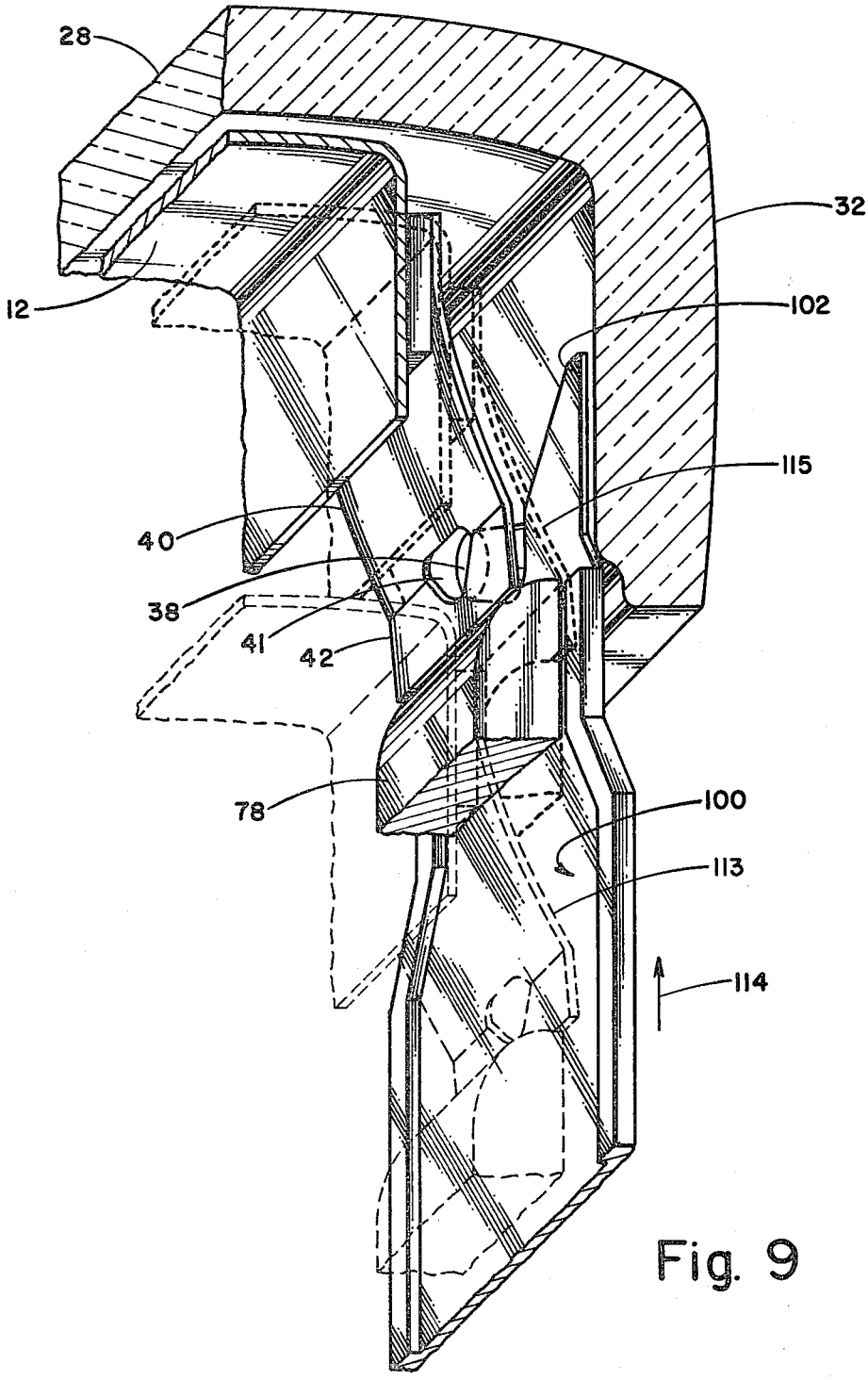
FIG. 9 is a perspective view depicting in sequence the details of the engagement of an aperture of a suspension spring with a stud according to the invention; and, FIG. 10A is a plan view of another embodiment of a leaf spring; and, FIG. 10B is a plan view of a depressor for the leaf spring embodiment depicted by FIG. 10A.

FIG. 9 shows in detail the sequence of action of spring pusher means 78 in pushing spring 40 along channel 100 toward stud 38: the direction of movement for engagement of aperture 41 with stud 38 is indicated by arrow 114. V-groove tip means 102 holds stud 38 firmly in alignment with channel 100. Platen 54, to which spring pusher 78 is attached and on which mask 12 is carried, continues its upward movement as propelled by center cam 66 until spring 40 is pushed over stud 38 with the result that aperture 41 positively snaps into substantial engagement with stud 38. The sequence is indicated by the dash-line configurations 113 and 115 of spring 42. Upon this engagement, as shown by the solid-line representation of spring 40, center cam 66, in conjunction with other elevator means components, continues its rotation to lower platen 54, sans mask, to the lower, pre-assembly position 64. Concurrently, as platen 54 is lowered, cams 97 continue in rotation to withdraw push rods 84. V-groove tip means 102 is in turn withdrawn from engagement with stud 38 as arm 86 is lowered.

The benefit of the means and method according to the invention is in providing consistent and unequivocal engagement of mask and panel.

With reference to FIG. 5, the components comprising the four groups A–D are essentially identical as far as operation according to the invention is concerned. The spring pusher of one of the groups, however, is different in configuration. Also, the aperture of the associated leaf spring is necessarily different in shape.

Any three of the suspension springs of the four-corner mask suspension system can establish the lateral longitudinal and rotational position of the mask in a fashion similar to the conventional three-stud panel suspension system. Any attempt to force the fourth aperture into its stud with lateral restraint is redundant, and normal manufacturing variations would result in forceful distortion of the mask assembly to secure seating. It is, however, necessary to restrain the torsionally flexible mask in the axial direction to establish and maintain the spatial position of the mask relative to the screen in the axial direction. These conditions are satisfied by forming the aperture in a fourth suspension spring as a laterally oriented slot which provides lateral freedom enabling the aperture to engage the associated stud without twisting the mask while retaining the proper axial position. For example, the shape of the apertures 41 of the leaf springs 40 associated with a spring engaging means 76 associated with groups A B & C are as shown by FIG. 7 as being, in effect, circular. The leaf spring associated with the spring engaging means of group D preferably has a configuration indicated by FIG. 10A, seen as comprising a laterally oriented slot. Aperture 116 as configured in spring 118 provides accomodation in engagement for normal manufacturing variations such as stud location errors and spring location errors. No such accomodation is allowable in the axial direction indicated by arrow 120 however. As a result of the lateral accomodation provided, but without axial accomodation, the torsionally flexible shadow mask 12 is properly positioned and stabilized relative to the patterns of phosphor triads.

Figure 10B:
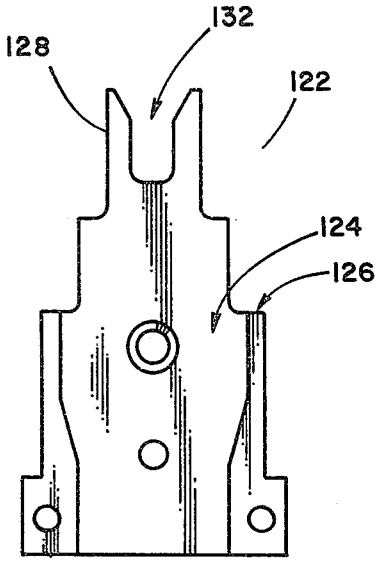

The requirement that the aperture 116 of spring 118 be allowed lateral freedom dictates that the associated spring depressor means be modified as well to tolerate normal manufacturing variations in mask and panel dimensions. With reference to FIG. 10B, a modified spring depressor means 122 is shown. Comparison with the adjacent drawing of spring depressor means 98 will show that channel 124 of spring depressor means 122 is much shorter in that it terminates at point 126 farther from the V-groove tip means 128 than is the case for spring depressor 98. The channel 100 of spring depressor means 98 will be seen to be much longer with the point of termination 130 closely adjacent to V-groove tip means 102. The shorter length of channel 124 provides latitude to the associated spring to allow the aperture 116 of spring 118 to seek the associated stud without restraint.

To ensure that the associated stud falls freely into the V-groove tip means 128 of spring depressor means 122, the width of the groove 132 is preferably made wider than the groove 134 of spring depressor means 98; e.g., about 0.070 inch greater in width. The width of the grooves in the other three spring depressor means 98 is about 0.260 inch.

In this, as with any automatic mask inserter system, it is a caveat that the studs of all panels be as identical in location as possible. Similarily, the apertures of the leaf springs of all masks should be as identical in location as possible. Depending upon the variance of manufacturing tolerance achieved, these requirements may mean that 100 percent inspection of both masks and panels is a requisite.

The inventive method for inserting a mask into a face panel is described in the following paragraphs.

Initial condition of apparatus: platen means 54 is in the upper assembly position 62 ready to receive the shadow mask 12.

(a) mask 12 is placed on platen means 54 either manually or by automatic pick-and-place equipment. Mask 12 is received on platen means 54 and located convex-side-up in the upper assembly position 62 by mask prelocating means 56. Spring-pusher means 78 are provided which extend from the corners of platen means 54 and are foldable into the platen means 54, but spring-biased outwardly to provide for engagement with channel 100 of spring depressor means 98.

(p) platen means 54 and mask 12 are lowered to a lower-pre-assembly position 64. Panel 28 is received convex-side-up with respect to mask 12 on table means 68 in the upper assembly position 62, and approximately located with respect to mask 12 by blocks 72. Placement of the panel may be manually, or by automatic pick-and-place equipment.

(c) the distal ends 42 of springs 40 are depressed adjacent to mask 12 by spring depressor means 98, as actuated by spring engaging means 76.

(d) channel means 100 are provided in spring depressor means 98 for accepting the distal ends 42 of springs 40. The channel means 100 are oriented longitudinally with respect to springs 40.

(e) studs 38 are located and aligned with channel means 100 as the V-groove tip means 102 engage studs 38. The engagement of the V-groove tip means 102 results in a re-positioning of the studs 38 to a precise, predetermined lateral position; lateral movement may be as much as 0.075 inch. At the same time, the V-groove tip means 102 are re-positioned vertically to predetermined positions approximately 0.125 inch up from table 62. So it is that the studs 38 are precisely located relative to the apparatus rather than to the panel 28 per se.

(f) the distal ends 42 of springs 40 are pushed by means of the spring pusher means 78 along channel means 100 toward and over studs 38. Concurrently mask 12 is raised into conjunction with panel 28 by the elevating of platen means 54 into the upper assembly position 62 for engagement therewith. As the distal ends 41 of springs 40 "cam" over the tip of studs 38, apertures 41 engage studs 38 as soon as alignment is obtained. Complete seating of the springs 40 on studs 38 is prevented by the V-groove tip means 102 as the outward movement of the distal ends 41 of springs 40 is arrested by the bottom of channel 100. Complete seating at this time is undesirable in that it tends to damage the studs and/or wedge the apertures so tightly onto the studs that the apertures lock onto the studs. The effect can cause problems in disengaging the springs from the studs and/or misregistration of mask and face panel.

(g) the V-groove tip means 102 are gently withdrawn, allowing the apertures 41 to fully but gently seat on the studs 38. If necessary, vibratory means can be used to encourage gentle seating of the apertures on the associated studs.

Actual disengagement of the V-groove tip means 102 from the studs 38 occurs as the panel 28 lowers to the pre-assembly position 64. (Panel 28 has been noted as being raised about 0.125 inch above table 68 by the V-groove tip means.) As the panel 28 is lowered, it re-contacts the top of table 62. Subsequent disengagement of springs 40 and channels 100 occurs as spring depressor means 98 continues the downward shown by FIG. 6.

Of particular significance is the fact that positive "complete" engagement of the springs 40 and the studs 38 does not occur until the spring depressor means 98 are disengaged from the springs 40. Of additional significance is the fact that during the sequence of releasing the mask springs (so as to achieve "complete" engagement) the three non-slotted spring apertures; that is, apertures 41 of groups A, B and C, are released first. This sequence is necessary to position the mask assembly accurately in a lateral direction so as to achieve the aforedescribed complete engagement of each of the apertures 41 of springs 40 with the associated studs 38.

After the three apertures 41 of the springs 40 of groups A, B and C have been engaged the associated studs 38 (and after the mask has been precisely oriented laterally relative to the studs 38), the slot aperture 118 of spring 116 is released and full engagement of spring 118 with its associated stud takes place, thus providing axial orientation of the fourth corner.

Other changes may be made in the above-described apparatus and method without departing from the true spirit and scope of the invention herein involved. The apparatus according to the invention has been described as providing for the insertion of a mask suspended from a face panel at each of four corners. The inventive means and method is not so limited, but is valuable and applicable as well in suspension systems wherein, by way of example, the leaf springs, attached to a mask having a frame in an orientation substantially parallel with the tube axis, are suspended at points other than the corners of the mask frame. For example, the suspension means may comprise two springs located on each side (or end) of the mask, and adjacent to the corners. Similarily, the suspension system may comprise three suspension springs, two of which are located on opposing sides of the mask, with a third spring located on an adjacent side.

It is intended that subject matter of the foregoing depiction shall be interpreted as illustrative and not in a limiting sense.

We claim:

1. For use in the manufacture of a color cathode ray picture tube having a glass face panel with a rearwardly extending flange and a plurality of studs extending radially inwardly from said flange, said tube including a shadow mask suspended in precise proximity to said panel by an equal plurality of rearwardly extending leaf springs attached to said mask in an orientation substantially parallel with the axis of said tube, said springs having an aperture at their distal end for engagement with an associated one of said studs, engagement means for each spring for engaging said apertures with said studs during insertion of said mask into said panel, each engagement means comprising:

spring depressor means for bending the associated leaf spring adjacent to said mask, said spring depressor means including channel means parallel with said leaf spring for accepting the distal end of said spring;

V-groove tip means at a distal end of said spring depressor means and aligned with said channel means for locating and aligning said stud with said channel means;

pusher means for pushing said distal end of said leaf spring along said channel means toward and over said stud during mask insertion;

such that as the distal ends of said springs are pushed over said studs, said apertures, being aligned with said studs by said channel means positively snap into substantial engagement with said studs, providing consistent and unequivocal mutual engagement of said mask with said panel.

2. For use in the manufacture of a color cathode ray picture tube, apparatus for inserting the shadow mask of a mask-face panel assembly into said face panel, the assembly including:

a glass face panel having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals;

a corner mask-suspension system for rigidly and stably suspending said mask with said dished perforate central section of said mask spaced from said central section of said face panel, said suspension system consisting of four suspension devices, one at each corner of the mask, each device comprising:

a stud affixed to said face panel flange on the associated face panel diagonal and arranged to extend radially inwardly along said diagonal;

a leaf spring extending from said skirt and having an aperture at its distal end for detachably interconnecting said mask corner to said face panel flange by engagement of said aperture with said stud;

means for mounting said spring on said mask diagonal and normal to said diagonal such that said spring extends rearwardly away from said central section of said face panel, from a terminal point at or forwardly of said dished central section of said mask such that when said spring is deflected, the distal end thereof travels on an arc inwardly toward the face panel central axis;

said apparatus for inserting said mask in said face panel, comprising:

engagement means for engaging said apertures with said studs during insertion of said mask in said panel, each engagement means comprising:

spring depressor means for bending said spring adjacent to said mask, said spring depressor means including channel means parallel with said spring for accepting the distal end of said spring;

V-groove tip means at a distal end of said spring depressor means and aligned with said channel means for locating and aligning said stud with said channel means;

pusher means for pushing said distal end of said spring along said channel means toward and over said stud during mask insertion;

such that as the distal ends of said springs are pushed over said studs, said apertures, being aligned with said studs by said channel means, positively snap into substantial engagement with said studs, providing consistent and unequivocal mutual engagement of said mask with said panel.

3. For use in the manufacture of a color cathode ray picture tube, apparatus for inserting the shadow mask of a mask-face panel assembly into said face panel, the assembly including:

a glass face panel having a dished central section and a rearwardly extending flange;

a substantially rectangular, frameless shadow mask having a dished perforate central section and a rearwardly extending skirt, said mask being relatively stiff about its major and minor axes, but torsionally flexible and unstable with respect to its diagonals; and a corner mask suspension system for rigidly and stably suspending said mask, with said dished perforate central section of said mask spaced from said central section of said face panel, said suspension system consisting of four suspension devices, one at each corner of the mask, each device comprising:

a stud affixed to said face panel flange on the associated faceplate diagonal and arranged to extend radially inwardly along said diagonal;

a leaf spring extending from said skirt and having an aperture at its distal end for detachably interconnecting said mask corner to said face panel flange by engagement of said aperture with said stud;

means for mounting said spring on said mask diagonal and normal to said diagonal such that said spring extends rearwardly away from said central section of said face panel from a terminal point at or forewardly of said dished central section of said mask, such that when said spring is deflected, the distal ends thereof travels on an arc inwardly toward the face panel central axis;

said apparatus for inserting said mask in said face panel comprising:

platen means with mask frame-prelocating means for receiving and locating said mask convex-side-up on said platen means, the corners of said platen means having hingedly extending therefrom spring-pusher means foldable into said platen;

elevator means for raising and lowering said platen means and said mask between an upper assembly position and a lower, preassembly position;

table means in said upper assembly position for receiving and approximately locating said panel convex-side-up with respect to said mask, said table means having an opening for receiving said platen means in approximate coplanarity;

means at said lower assembly position for preparing, when said platen is lowered to said lower assembly position, said mask for engagement with said panel including:

spring depressor means for bending the distal end of said springs adjacent to said mask, said means including channel means parallel with said spring for accepting said distal end of said springs;

V-groove tip means at the distal end of said spring depressor means and said channel means for locating and aligning said studs with said channel means;

spring pusher means for pushing said distal end of said springs along said channel means toward and over said studs when said platen and said mask are raised into conjunction with said panel by said elevator means for engagement of said mask therewith;

means for withdrawing said V-groove tip means from said studs when said mask is lowered by said elevator means upon engagement of said apertures with said studs;

such that as the distal ends of said springs are pushed over said studs, said apertures being aligned with said studs by said channel means, positively snap into substantial engagement with said studs to provide consistent and unequivocal mutual engagement of said mask with said panel.

4. For use in the manufacture of a color cathode ray picture tube having a substantially rectangular face panel with a rearwardly extending flange and with a plurality of studs extending radially inwardly from said flange, said tube including a shadow mask suspended in precise proximity to said panel by and equal plurality of rearwardly extending leaf springs attached to said mask in an orientation substantially parallel with the axis of said tube, said springs having an aperture at said distal end for engagement with an associated one of said studs, a method for engaging said apertures with said studs during insertion of said mask into said panel comprising:

depressing said springs into adjacency to said mask by spring depressor means;

providing channel means in said spring depressor means for accepting said distal ends of said springs, and orienting said channel means parallel with said springs;

locating and aligning said studs with said channel means;

pushing said distal ends of said springs along said channel means toward and over said studs while inserting said mask into said face panel;

such that as the distal ends of said springs are pushed over said studs, said apertures, being aligned with said studs by said channel means, positively snap into substantial engagement with said studs, providing consistent and unequivocal mutual engagement of said mask with said panel.

5. For use in the manufacture of a color cathode ray picture tube having a substantially rectangular face panel with a rearwardly extending flange and with a plurality of studs extending radially inwardly from said flange, said tube including a shadow mask suspended in precise proximity to said panel by an equal plurality of rearwardly extending leaf springs attached to said mask in an orientation substantially parallel with the axis of said tube, said springs having an aperture at their distal end for engagement with an associated one of said studs, a method for engaging said apertures with said studs during insertion of said mask into said panel comprising:

receiving and locating said mask convex-side-up in an upper assembly position on platen means;

providing spring pusher means extending from the corners of said platen means and foldable into said platen means;

lowering said platen means and said mask to a lower, pre-assembly position;

receiving and approximately locating in said upper assembly position said panel convex-side-up with respect to said mask;

depressing the distal end of said springs into adjacency to said mask by spring-depressor means;

providing channel means in said spring depressor means for accepting said distal ends of said springs, and orienting said channel means parallel to said springs;

locating and aligning said studs with said channel means by V-groove tip means located at the ends of said spring depressor means and aligned with said channel means;

pushing by means of said spring pusher means said distal ends of said springs along said channel means toward and over said studs while concurrently raising said mask into conjunction with said panel for engagement therewith;

lowering said platen upon engagement of said mask with said panel, and withdrawing said V-groove tip means;

such that as the distal ends of said springs are pushed over said studs, said apertures, being aligned with said studs by said channel means, positively snap into substantial engagement with said studs, providing consistent and unequivocal mutual engagement of said mask with said panel.

* * * * *